United States Patent [19]

Soeder

[11] 4,126,784

[45] Nov. 21, 1978

[54] X-RAY DIAGNOSTICS GENERATOR COMPRISING A DIRECTLY HEATED X-RAY TUBE

[75] Inventor: Eickhardt Soeder, Erlangen, Germany

[73] Assignee: Siemens Aktiengesellschaft, Berlin & Munich, Germany

[21] Appl. No.: 793,630

[22] Filed: May 4, 1977

[30] Foreign Application Priority Data

Nov. 22, 1976 [DE] Fed. Rep. of Germany ..... 2652940

[51] Int. Cl.[2] ..... H05G 1/10

[52] U.S. Cl. ..... 250/421

[58] Field of Search ..... 250/421

[56] References Cited

U.S. PATENT DOCUMENTS 1,250,731 12/1917 Waite ..... 250/421

*Primary Examiner*—Alfred E. Smith
*Assistant Examiner*—T. N. Grigsby
*Attorney, Agent, or Firm*—Hill, Gross, Simpson, Van Santen, Steadman, Chiara & Simpson

[57] ABSTRACT

In the illustrated embodiments the primary voltage of the high voltage transformer is supplied via a voltage divider so that the secondary voltage does not exceed a desired value during heating of the X-ray tube filament. As the secondary load increases with a consequent tendency to reduce secondary voltage, an element or elements of the voltage divider are switched so as to increase the voltage supplied to the primary winding of the high voltage transformer. In a monopulse circuit, diode means are associated with the voltage divider which are poled such that the voltage divider controls the positive polarity secondary half wave voltage. In one embodiment, a single switch may simultaneously bypass the series resistance of the voltage divider and remove a parallel resistance with respect to one polarity of primary current. In another embodiment, the parallel voltage divider resistance is progressively increased during heating of the X-ray tube filament and then the series resistance of the voltage divider is bypassed with respect to one polarity of primary current, for example, so as to tend to maintain a desired secondary voltage with respect to the corresponding secondary monopulse polarity. Similar circuits are applicable to multipulse generators.

5 Claims, 5 Drawing Figures

X-RAY DIAGNOSTICS GENERATOR COMPRISING A DIRECTLY HEATED X-RAY TUBE

BACKGROUND OF THE INVENTION

The invention relates to an x-ray diagnostics generator comprising an x-ray tube and a high voltage transformer, wherein the heating filament of the x-ray tube is connected to one portion of the secondary winding of the high voltage transformer, and wherein a photograph-release (or trigger) mechanism is disposed in the primary circuit of the high voltage transformer. An x-ray diagnostics generator wherein the heating filament of the x-ray tube is connected to one portion of the secondary winding of the high voltage transformer is termed directly heated.

In the case of a generator such as this, the heating transformer and the high voltage transformer are switched on simultaneously; i.e., the heating voltage and the high voltage are simultaneously connected to the x-ray tube. Since, due to the inertia (or lag) of the heating filament, no x-ray tube current flows during the first period after the switching-on operation, virtually no voltage drops occur due to the mains and transformer resistances. The secondary no-load (or open-circuit) voltage is therefor substantially greater than the secondary load voltage. This leads to insulation problems.

SUMMARY OF THE INVENTION

The object which is the basis of the invention consists in introducing an x-ray diagnostics generator of the type initially cited wherein the difference between the secondary no-load voltage and the secondary load voltage is small in the case of both half-waves. The subject of the invention is intended to comprise a monopulse generator as well as a multipulse generator.

As specified by the invention, this object is achieved in that the primary voltage of the high voltage transformer is tapped at a voltage divider whose series resistance can be bridged by a switch. In the case of the inventive generator, it is possible, after heating the heating filament of the x-ray tube, to bridge the series resistance of the voltage divider and thereby boost the secondary load voltage.

In that instance in which the x-ray diagnostics generator operates in a monopulse circuit arrangement wherein the negative secondary half-wave always occurs in the idle (or no-load) operation, a further development of the invention, provides that a diode be connected in series with the switch, said diode being poled such that it is transmissive during the positive secondary half-wave. The negative half-wave is here always attenuated by the voltage divider, whereas the positive half-wave is only attenuated when the switch is opened; thus, during the heating-up period. In order to prevent any current from flowing through the divider resistance, constructed as the sole parallel resistance, a further embodiment of the invention provides that a diode can be connected in series with the divider resistance, which diode is transmissive during the negative secondary half-wave voltage pulses, and which diode is connected with its negative pole to the switch, and is capable of being short-circuited by the switch in the case of a non-bridged series resistance. A further embodiment of the invention provides that the divider resistance consist of the parallel connection of two series connections of resistances and diodes, and that the diodes be oppositely poled in relation to one another. In this case, one of the resistances, respectively, of the divider resistance is decisive for each respective primary half-wave voltage polarity, and asymmetries in the primary current caused by the high voltage transformer can be compensated. Finally, a further development of the invention consists in that means are provided by which the divider resistance can be gradually (or step-by-step) enlarged subsequent to actuation of the photograph-release (or trigger) mechanism and prior to actuation of the series resistance bypass switch. In this manner, it is possible to keep very low the voltage peak which occurs upon actuation of the switch because, in the initial instant following actuation of the switch, the temperature of the heating filament of the x-ray tube has not yet attained the value corresponding to the heating current; i.e., it is too low, so that the x-ray tube current is also too low.

Other objects, features and advantages of the present invention will be apparent from the following detailed description taken in connection with the accompanying sheets of drawings.

DETAILED DESCRIPTION

Figure 1:
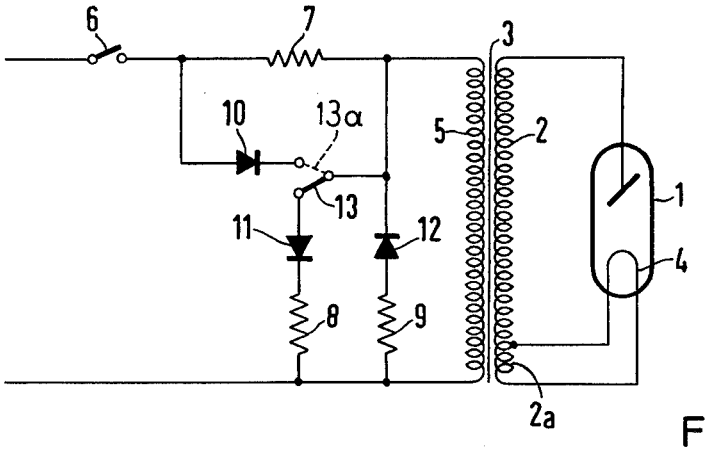
FIG. 1 is a circuit diagram illustrating a first embodiment in accordance with the present invention.

In the sample embodiment according to FIG. 1, an x-ray tube 1 is connected with its cathode-anode-section to secondary winding 2 of a high voltage transformer 3. Secondary winding 2 is provided with a section **2*a* supplying the heating voltage for heating filament 4 of x-ray tube 1. Primary winding 5 is connectable to the mains supply via a photograph-release (or trigger) mechanism 6. Disposed between photograph-release mechanism 6 and primary winding 5 is a voltage divider consisting of a series resistance 7 and a divider resistance formed from two resistances 8 and 9. In addition, three diodes 10, 11, and 12, as well as a switch 13** are present.

Figure 3:
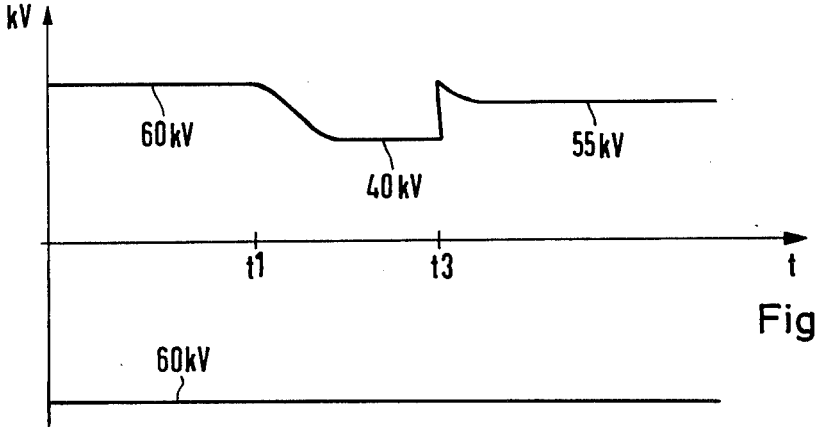
FIG. 3 illustrates the secondary voltage variation as a function of time and is used for explaining the operation of the embodiment of FIG. 1, for example.

On the basis of FIG. 3, the mode of operation of the x-ray diagnostics generator according to FIG. 1 is explained in further detail: First, the photograph-release (or trigger mechanism) 6 is closed and switch 13 occupies the illustrated position. The primary voltage of the high voltage transformer 3 is reduced as compared with the mains supply voltage; namely, it is divided down for each half-wave by voltage divider 7, 8, 9. According to FIG. 3, 60 kV, for example, in both secondary half-waves corresponds to applied primary voltage.

At time point *t*1, x-ray tube current begins to flow, and the positive half-wave of the secondary voltage of the high voltage transformer 3 drops to 40 kV, for example. After this value has been reached, switch 13 is shifted into its position illustrated by broken lines at **13*a*** at time *t*3. In this position, series resistance 7 of voltage divider 7, 8, 9, is short-circuited during the positive half-wave, so that the primary voltage increases during the positive half-wave, and thus the positive half-wave of the secondary voltage also increases. The positive half-wave of the secondary voltage increases at time *t*3 beyond the value of 60kV, since, directly after the switching-over process, the temperature of heating filament 4 has not yet reached its final operating value which is higher than before, and therefore the x-ray tube current is still too small and the voltage drop on the mains and transformer resistances is likewise still too small. After heating-up of the heating filament 4, following time *t*3, the positive half-wave of the secondary voltage has dropped to its final value of 55 kV, for example. The negative half-wave is divided by the voltage divider 7, 8, 9, during the heating-up phase as well as during the final operating state, and constantly has a value of 60 kV, since the high voltage transformer 3 always operates in an idle (or no-load) condition during the negative half-wave. From FIG. 3 it is apparent that the differences between the secondary no-load (or open-circuit) voltage and the secondary load voltage are very small, so that insulation problems hardly occur.

The parallel branch consisting of the oppositely poled diodes 11 and 12 and resistances 8 and 9 makes it possible to compensate for asymmetries between the respective polarities of half-waves of the primary current of high voltage transformer 3 through a suitable selection of resistances 8 and 9. If this is not provided, diodes 11 and 12, and resistances 8 and 9, can be replaced by a single diode 14 and a single resistance 15 as the divider resistance, such as is illustrated in the example according to FIG. 2. In this example, subsequent to actuation of switch 13 to position 13*a*, diode 14 is blocked during the positive half-wave of the secondary load voltage, so that resistance 15 does not affect such positive half-wave.

Figure 2:
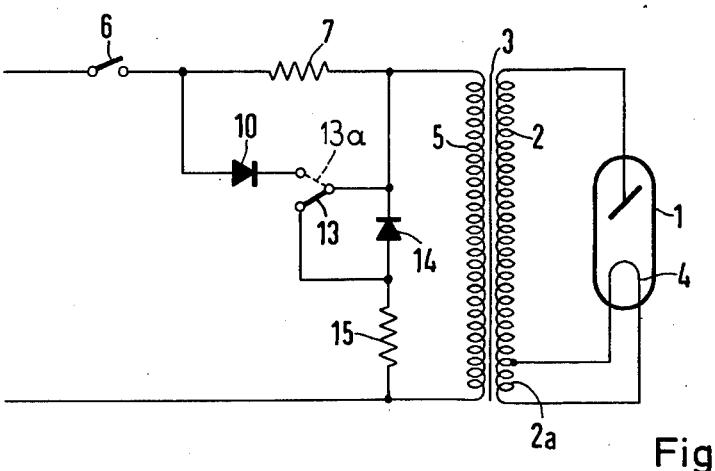
FIG. 2 is an electric circuit diagram showing a second embodiment.
Figure 4:
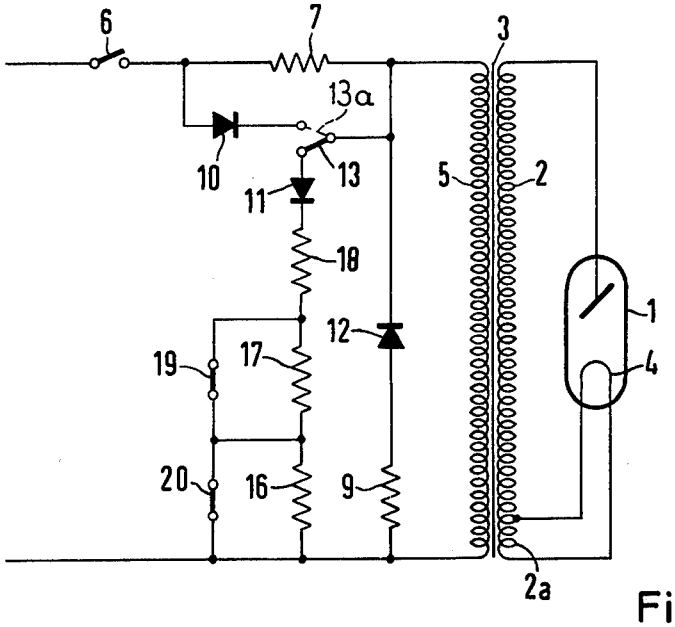
FIG. 4 illustrates a third exemplary embodiment in accordance with the present invention.

The example according to FIG. 4 makes it possible to substantially reduce the voltage peak which otherwise occurs as shown in FIG. 3 at *t*3, and to also further reduce the secondary no-load (or open-circuit) voltage with regard to the secondary load voltage in comparison with the examples according to FIGS. 1 and 2. In this example, instead of resistance 8 according to FIG. 1, the series-connection consisting of three resistances 16, 17, and 18, is provided, of which resistance 17 is short-circuited by a switch 19 and resistance 16 is short-circuited by a switch 20.

Figure 5:
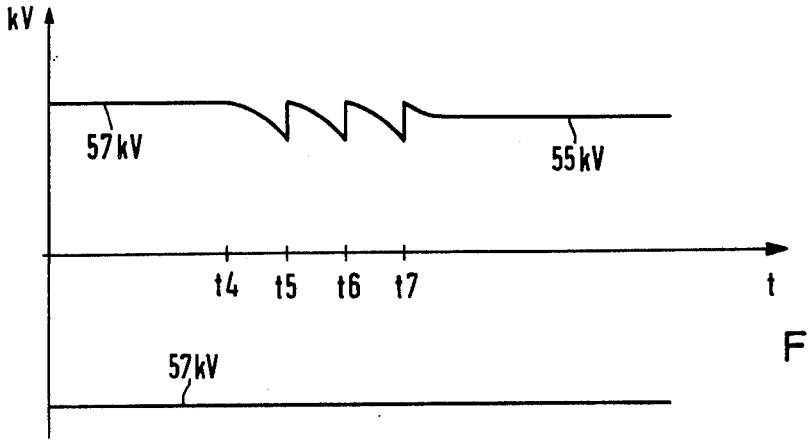
FIG. 5 is a diagrammatic illustration of the variation of secondary voltage as a function of time and explaining the operation of the embodiment of FIG. 4.

The actuation sequence of the switches is 6, 20, 19, 13. From FIG. 5, it is apparent that the no-load (or open-circuit) secondary voltage of both half-waves amounts to 57 kV, for example. At time *t*4, heating filament 4 has been heated to such an extent that the x-ray tube current begins to flow and directly thereafter; namely, at time *t*5, switch 20 is opened. The primary voltage consequently increases somewhat; namely, again to the value of 57 kV in the example, and then subsequently decreases somewhat again, because the temperature of the heating filament 4 is increasing. At time *t*6, switch 19 is opened, so that the secondary load voltage again rises to the value of 57 kV. Subsequently, due to the increase in the temperature of heating filament 4, it again drops as time *t*7 is approached. At time *t*7, switch 13 is shifted into its position illustrated by broken lines at 13*a*, and the secondary load half-wave again increases to the value of 57 kV. It then drops to the final value of 55 kV as a consequence of the further increase in the temperature of heating filament 4. The primary half-wave corresponding to the negative secondary half-wave does not flow through components 11, 16 through 18. On the contrary, this primary half-wave current flows through components 9 and 12 as well as through series resistance 7, in each position of switch 13, and it is constant (in the example, it is 57 kV). The condition underlying the curves according to FIGS. 3 and 5 is that, at time zero, the photograph-release (or trigger) mechanism 6 has been closed.

The circuits illustrated in FIGS. 1, 2 and 4, are adaptable so, that they may also be used for multipulse generators. In this case, all the diodes contained in the examples according to FIGS. 1 and 2, would be eliminated. In the example according to FIG. 4, in place of resistance 9, there would be an arrangement corresponding to components 16 through 20. Diodes 10, 11, 12, would be eliminated. The switches would then be suitably actuated so as to be in relative synchronism with one another.

It will be apparent that many modifications and variations may be effected without departing from the scope of the novel concepts and teachings of the present invention.

I claim as my invention:

1. An x-ray diagnostics generator comprising an x-ray tube and a high voltage transformer wherein the heating filament of the x-ray tube is connected to one portion of the secondary winding of the high voltage transformer, and wherein a photograph-release mechanism is disposed in the primary circuit of the high voltage transformer, a voltage divider for providing primary voltage to said transformer, said voltage divider including a first resistor connected in series with said photograph-release mechanism and a switch connected across said first series connected resistor.

2. A generator according to claim 1, in a monopulse circuit arrangement, characterized in that a diode is disposed in series with the switch, said diode being poled such that it is transmissive during the positive secondary half-wave.

3. A generator according to claim 1, characterized in that the voltage divider has a single shunt resistor, and a diode series-connected therewith, which is transmissive during the negative secondary half-wave, which is connected with its negative pole to the switch, and which is capable of being short-circuited by the switch in the case of a non-bridged series connected resistor.

4. A generator according to claim 1, characterized in that the voltage divider further comprises a parallel-connection of two series-connections of resistances and diodes, and that the diodes are oppositely poled.

5. Generator according to claim 1, characterized in that the voltage divider further comprises means whereby the voltage divider shunt resistance can be gradually enlarged subsequent to actuation of the photograph-release mechanism and prior to actuation of the switch.

* * * * *